US009734943B2

(12) United States Patent
Liu et al.

(10) Patent No.: US 9,734,943 B2
(45) Date of Patent: Aug. 15, 2017

(54) ELECTROMAGNETIC DEVICE AND CONDUCTIVE STRUCTURE THEREOF

(71) Applicant: Delta Electronics (Shanghai) Co., Ltd., Shanghai (CN)

(72) Inventors: Teng Liu, Shanghai (CN); Ai-Xing Tong, Shanghai (CN)

(73) Assignee: DELTA ELECTRONICS (SHANGHAI) CO., LTD., Shanghai (CN)

( * ) Notice: Subject to any disclaimer, the term of this patent is extended or adjusted under 35 U.S.C. 154(b) by 204 days.

(21) Appl. No.: 14/447,640

(22) Filed: Jul. 31, 2014

(65) Prior Publication Data

US 2015/0116063 A1 Apr. 30, 2015

(30) Foreign Application Priority Data

Oct. 29, 2013 (CN) ..... 2013 1 0522211

(51) Int. Cl.
*H01F 27/08* (2006.01)
*H01F 27/28* (2006.01)
*H01F 27/32* (2006.01)

(52) U.S. Cl.
CPC ..... *H01F 27/2847* (2013.01); *H01F 27/2876* (2013.01); *H01F 27/323* (2013.01)

(58) Field of Classification Search
CPC ..... H01F 30/12; H01F 27/22; H01F 27/322; H01F 27/2876; H01F 27/2823; H01F 27/306; H01F 27/325; H01F 27/323; H01F 17/02; H01F 27/303
USPC ..... 336/12, 55, 60, 61, 62, 180, 185, 198, 336/199, 206, 207
See application file for complete search history.

(56) References Cited

U.S. PATENT DOCUMENTS 600,057 A * 3/1898 Ball ..... H01C 3/10 336/205
2,544,845 A * 3/1951 Link ..... H01F 27/2876 336/184
3,086,184 A * 4/1963 Nichols ..... H01F 27/322 336/192
3,160,132 A 12/1964 Mowatt
3,170,134 A * 2/1965 Palmer ..... H01F 27/322 336/205
3,237,136 A * 2/1966 Ford ..... H01F 27/322 156/184
3,447,112 A * 5/1969 Broverman ..... H01F 27/085 336/185
3,585,276 A 6/1971 Beckett
(Continued)

FOREIGN PATENT DOCUMENTS

CN 101061362 A 10/2007
CN 102610374 A 7/2012
(Continued)

*Primary Examiner* — Tsz Chan
(74) *Attorney, Agent, or Firm* — CKC & Partners Co., Ltd.

(57) ABSTRACT

A conductive structure for an electromagnetic device includes a conductive sheet and a plurality of protrusions. The conductive sheet includes two electrical connection terminals. The protrusions are arranged between the electrical connection terminals. The protrusions include a support. The support is connected to the conductive sheet. Adjacent two of the protrusions define a first heat dissipation passage.

21 Claims, 10 Drawing Sheets

(56) References Cited

U.S. PATENT DOCUMENTS

| | | | | |
|---|---|---|---|---|
| 5,512,731 | A * | 4/1996 | McWilliams | H05B 3/748<br>219/461.1 |
| 2004/0017276 | A1 * | 1/2004 | Chen | H01F 17/04<br>336/192 |

FOREIGN PATENT DOCUMENTS

| | | | | |
|---|---|---|---|---|
| JP | 03155605 | A | * | 7/1991 |
| JP | H03155605 | A | | 7/1991 |

* cited by examiner

ELECTROMAGNETIC DEVICE AND CONDUCTIVE STRUCTURE THEREOF

RELATED APPLICATIONS

This application claims priority to China Application Serial Number 201310522211.7, filed Oct. 29, 2013, which is herein incorporated by reference.

BACKGROUND

Technical Field

Embodiments of the present invention relate to an electromagnetic device. More particularly, embodiments of the present invention relate to an electromagnetic device and the conductive structure thereof.

Description of Related Art

Electromagnetic device is one of the key components in the electricity system. For example, the electromagnetic device, such as the electric reactor and the transformer, has been widely applied in various electricity systems. However, the electromagnetic device inevitably produces heat energy during operation. In order to make the electromagnetic device work normally without being affected by the heat energy, various heat dissipation techniques are employed.

The heat dissipation technology generally includes the liquid cooling and the air cooling. In the liquid cooling, a liquid cooling plate is positioned on a particular position in the electromagnetic device. The liquid flows through the liquid cooling plate, absorbing and taking away the heat, so as to achieve heat dissipation. In addition to the liquid cooling plate, the accessories, such as the circulation fluid tank, the circulation pump, the heat exchanger and the pipes, are required as well, which increase the cost. Moreover, lots of joints exist in the circulation path of the fluid, and therefore, the fluid may leak and damage the electromagnetic device.

In the air cooling, some insulation pillars are disposed between the magnetic core and the winding, and some insulation pillars are disposed between the layers of the winding, so as to define airflow passages. The cool air flows into the airflow passage, and then, it absorbs heat and flows out of the airflow passage, so as to achieve heat dissipation. However, because the heat dissipation ability of the air cooling is in positive correlation with the contact area where the winding contacts with the airflow, the contact area is determined by the surface area of the winding. As a result, due to the limit of the surface area of the winding, the heat ability of the air cooling is limited, which is difficult to satisfy the requirement of the heat dissipation ability of the high power electromagnetic device.

SUMMARY

One aspect of the present disclosure is to improve the heat dissipation ability of the electromagnetic device.

In accordance with one embodiment of the present invention, a conductive structure for an electromagnetic device includes a conductive sheet and a plurality of protrusions. The conductive sheet has two electrical connection terminals. The protrusions are arranged between the electrical connection terminals. The protrusions include a support which connects with the conductive sheet. Two of the protrusions adjacent to each other define a first heat dissipation passage.

In accordance with another embodiment of the present disclosure, an electromagnetic device includes a winding.

The winding includes at least one conductive structure. The conductive structure includes a conductive sheet and a plurality of protrusions. The conductive sheet has two electrical connection terminals. The protrusions are arranged between the electrical connection terminals. The protrusions include a support connected to the conductive sheet. Two of the protrusions adjacent to each other define a first heat dissipation passage.

In accordance with another embodiment of the present disclosure, an electromagnetic device includes an insulation structure and two conductive layers. The insulation structure is sandwiched between two conductive layers. At least one of the conductive layers includes a conductive structure. The conductive structure includes a conductive sheet and a plurality of protrusions. The conductive sheet has two electrical connection terminals. The protrusions are arranged between the electrical connection terminals. The protrusions include a support connected to the conductive sheet. Two of the protrusions adjacent to each other define a first heat dissipation passage.

In the foregoing conductive structure, protrusions are disposed on the conductive sheet. As such, the contacting surface that the conductive structure contacts with the airflow may not be planar and may be uneven, which may effectively improve the heat dissipation ability.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
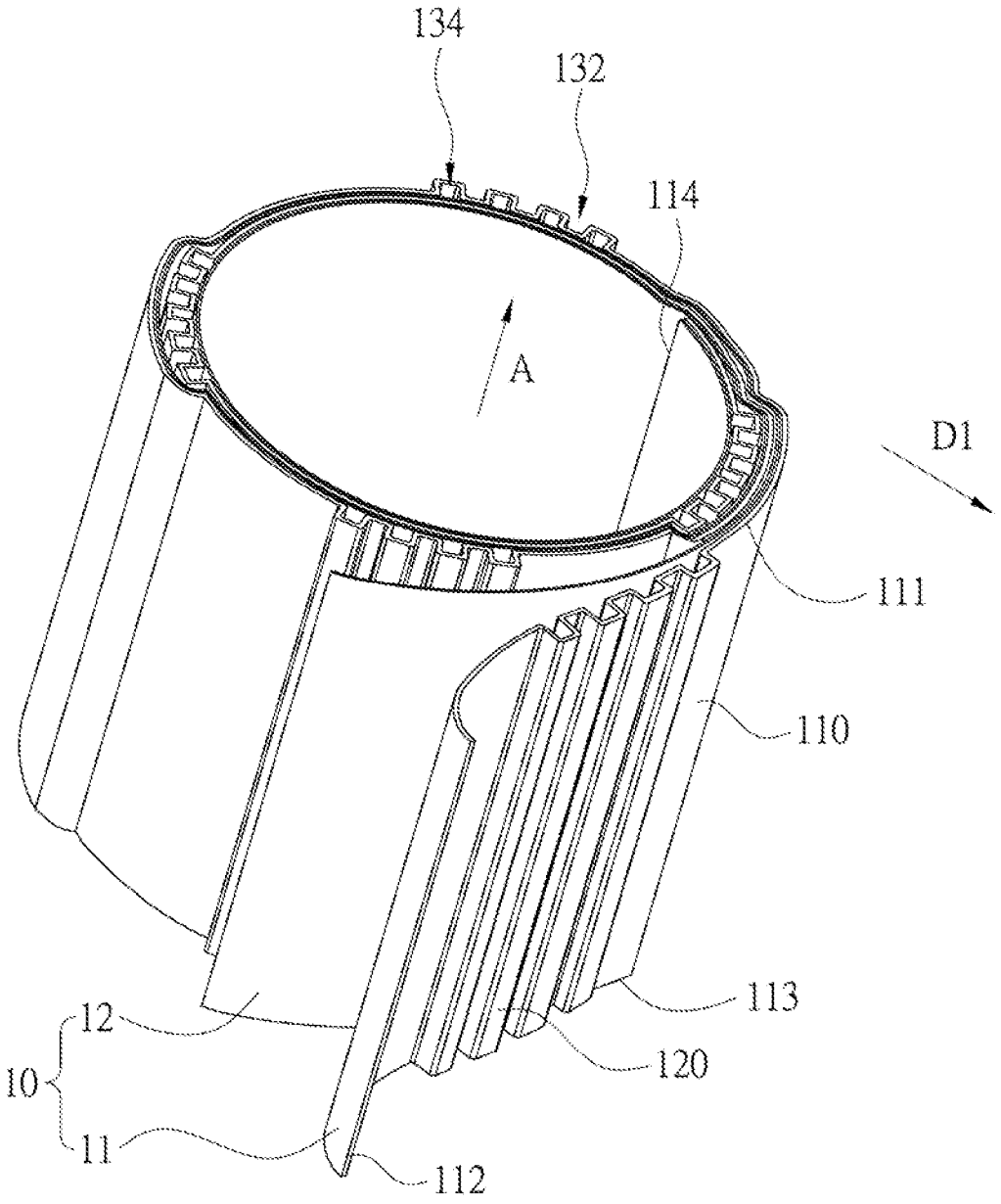
FIG. 1 is a perspective view of the electromagnetic device in accordance with one embodiment of the present disclosure.

Reference will now be made in detail to the present embodiments of the invention, examples of which are illustrated in the accompanying drawings. Wherever possible, the same reference numbers are used in the drawings and the description to refer to the same or like parts. However, the details disclosed below may not be all essential or necessary, and are not for limitation of present invention.

Figure 2:
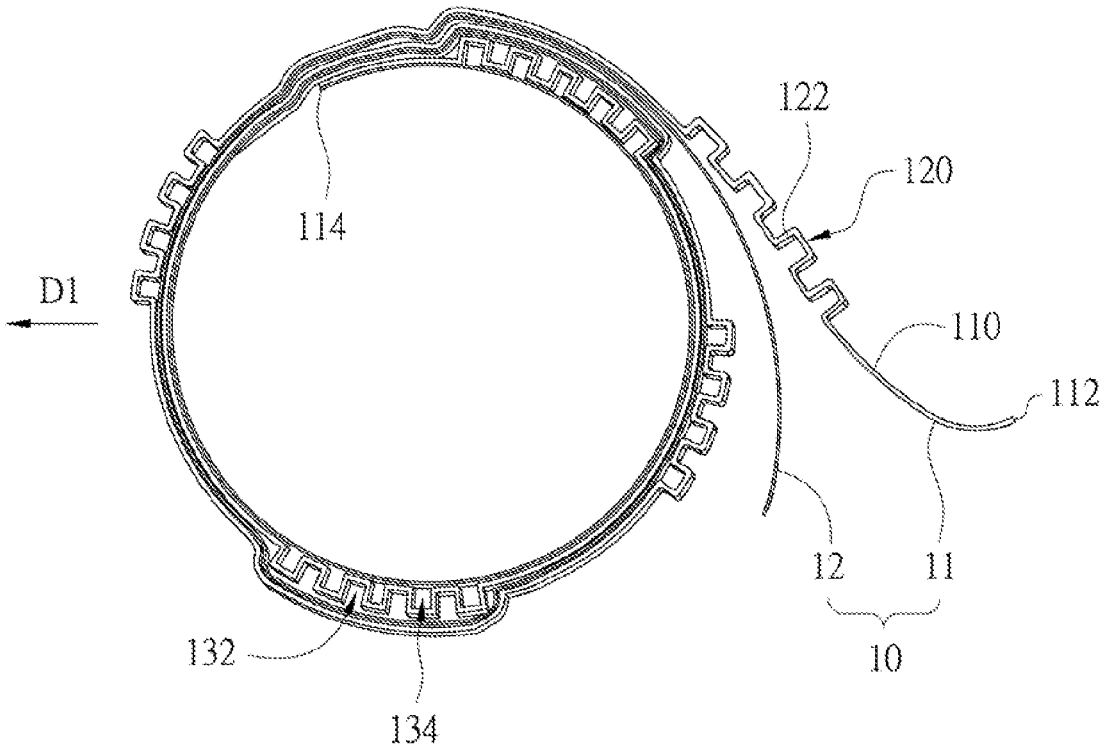
FIG. 2 is a top view of the electromagnetic device in FIG. 1.

FIG. 1 is a perspective view of the electromagnetic device in accordance with one embodiment of the present disclosure. FIG. 2 is a top view of the electromagnetic device in FIG. 1. As shown in FIGS. 1 and 2, the electromagnetic device includes a winding 10. The winding 10 includes a conductive structure 11. The conductive structure 11 includes a conductive sheet 110 and a plurality of protrusions 120. The conductive sheet 110 has two electrical connection terminals 112 and 114 for connecting external electric devices. The protrusions 120 are disposed on the conductive sheet 110. Each of protrusions 120 includes a support 122. The supports 122 are connected to the conductive sheet 110. The protrusions 120 and the conductive sheet 110 are conductors. The protrusions 120 are arranged between the electrical connection terminals 112 and 114. As shown in FIG. 2, two of the protrusions 120 adjacent to each other define a first heat dissipation passage 132. When the conductive structure 11 is conducted, the current flows through the conductive sheet 110 and the protrusions 120, and makes the conductive sheet 110 and the protrusions 120 generate heat. The airflow blown by heat dissipation fan (not shown) at least passes through the first heat dissipation passage 132, so as to transfer the heat generated from the conductive sheet 110 and the protrusions 120, thereby achieving heat dissipation. Further, because the protrusions 120 are protruded on the conductive sheet 110, the contacting surface that the conductive structure 11 contacts with the airflow is not planar and is uneven, which may effectively improve the heat dissipation ability.

Figure 3:
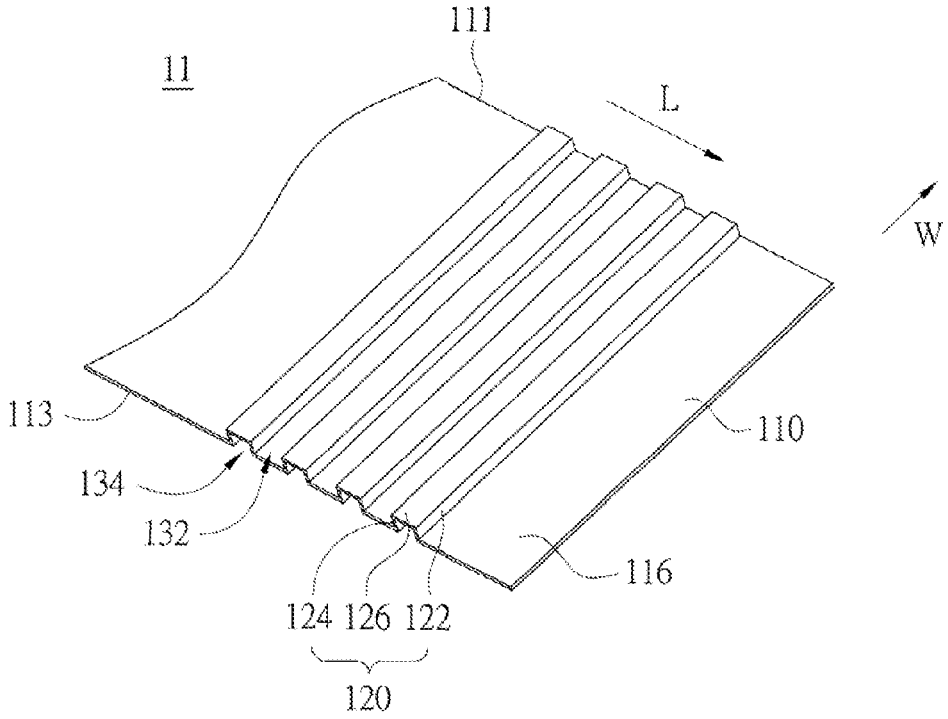
FIG. 3 is a fragmentary perspective view of the conductive structure in FIG. 1.

As shown in FIG. 1, the conductive sheet 110 includes a top long side 111 and a bottom long side 113. The top long side 111 and the bottom long side 113 connect with and are adjoined between the electrical connection terminals 112 and 114 (See FIG. 1). FIG. 3 is a fragmentary perspective view of the conductive structure 11 in FIG. 1. As shown in FIG. 3, in this embodiment, the conductive sheet 110 has a lengthwise direction L and a widthwise direction W perpendicular to the lengthwise direction L. The lengthwise direction L extends across the electrical connection terminals 112 and 114 (See FIG. 1 or 2). The widthwise direction W extends across the top long side 111 and the bottom long side 113. The protrusions 120 are arranged along the lengthwise direction L of the conductive structure 11, and they are arranged at intervals. In such a configuration, the first heat dissipation passage 132 between two of the protrusions 120 adjacent to each other can extend along the widthwise direction W of the conductive sheet 110, such that the airflow can flow along the widthwise direction W of the conductive sheet 110. Further, as shown in FIG. 1, the winding 10 has an axial direction A. After the conductive structure 11 is wound as a cylinder, the widthwise direction W of the conductive sheet 110 (See FIG. 3) is the axial direction A of the winding 10, and the airflow can flow through the first heat dissipation passage 132 along the axial direction A of the winding 10, so as to maybe facilitate heat dissipation. In this embodiment, the lengthwise direction L is the direction parallel to the longest side of the conductive sheet 110, and the widthwise direction W is the direction parallel to the side that is only shorter than the longest side of the conductive sheet 110.

In some embodiments, as shown in FIG. 3, each of the protrusions 120 has a second heat dissipation passage 134 therein. The second heat dissipation passage 134 and the first heat dissipation passage 132 are arranged alternately. In particular, each of the protrusions 120 includes two opposite supports 122, 124 and a top plate 126. The supports 122 and 124 are connected to the conductive sheet 110. The top plate 126 is connected to the sides of the supports 122 and 124 that are farthest from the conductive sheet 110. A second heat dissipation passage 134 is formed between the supports 122 and 124 of one of the protrusions 120. In other words, the second heat dissipation passage 134 is positioned within the protrusion 120 and between the supports 122 and 124. In detail, at least one of the protrusions 120 is a stick that connects the top long side 111 and the bottom long side 113, is a hollow structure having two openings on opposite ends thereof, and has a second heat dissipation passage 134 therein. The supports 122 and 124 of the protrusion 120 being a stick are flat.

The supports 122 and 124 are arranged along the lengthwise direction L of the conductive sheet 110, and therefore, the second heat dissipation passage 134 between the supports 122 and 124 can extend along the widthwise direction W of the conductive sheet 110. As such, the airflow can flow in the second heat dissipation passage 134 along the widthwise direction W of the conductive sheet 110. As a result, the airflow not only contacts with the outer surface of the protrusion 120, but also contacts with the inner surface of the protrusion 120, so as to maybe increase the contacting surface and improve the heat dissipation ability.

In some embodiments, as shown in FIG. 3, the first heat dissipation passage 132 and the second heat dissipation passage 134 are separated by the support 122 or 124. In other words, the first heat dissipation passage 132 and the second heat dissipation passage 134 are respectively positioned on opposite sides of the support 122 or 124. Therefore, the extension directions of the first heat dissipation passage 132 and the second heat dissipation passage 134 are the same as the extension directions of the supports 122 and 124. In other words, the first heat dissipation passage 132 and the second heat dissipation passage 134 extend along the widthwise direction W of the conductive sheet 110.

In some embodiments, as shown in FIG. 3, the conductive sheet 110 has a connecting surface 116. The protrusions 120 are connected to the connecting surface 116. As shown in FIG. 3, the protrusion 120 has a cross-sectional pattern defined along a direction perpendicular to the connecting surface 116, and the cross-sectional pattern is inverted-U shaped. In other embodiments, the cross-sectional pattern of the protrusion 120 defined along the direction perpendicular to the connecting surface 116 can be, but is not limited to be, inverted-V shaped, trapezoidal or arc-shaped.

In some embodiments, as shown in FIG. 3, all of the protrusions 120 have the same cross-sectional patterns defined along the direction perpendicular to the connecting surface 116. In other embodiments, at least two of the protrusions 120 have different cross-sectional patterns defined along a direction perpendicular to the connecting surface 116. For example, some protrusions 120 have inverted-U shaped cross-sectional pattern defined along the direction perpendicular to the connecting surface 116, and some protrusions 120 have arc-shaped cross-sectional pattern defined along the direction perpendicular to the connecting surface 116.

In some embodiments, as shown in FIG. 3, the protrusions 120 and the conductive sheet 110 are integrally formed. For example, the conductive sheet 110 and the protrusions 120 are formed by the same conductive piece, and the protrusions 120 are formed by punching the conductive piece. In some embodiments, the material of the conductive sheet 110 and the protrusions 120 includes, but is not limited to include, copper, aluminum, copper alloy or aluminum alloy.

In some embodiments, as shown in FIG. 2, the protrusions 120 are arranged on a partial area of the conductive sheet 110. In other words, the protrusions 120 do not cover the whole conductive sheet 110. Namely, other area of the conductive sheet 110 does not have the protrusions 120 thereon. In other embodiments, the protrusions 120 can cover the whole conductive sheet 110.

In some embodiments, as shown in FIG. 2, the protrusions 120 are arranged equidistantly. In other words, the distance between any two of the protrusions 120 adjacent to each other is constant, so as to make the widths of different first heat dissipation passages 132 equal. In other embodiments, the protrusions 120 can be arranged non-equidistantly, so as to make the widths of different first heat dissipation passages 132 unequal.

In some embodiments, as shown in FIG. 1, winding 10 includes an insulation structure 12. The insulation structure 12 contacts with the conductive structure 11. The conductive structure 11 and the insulation structure 12 may be cooperatively wound as a cylinder. The insulation structure 12 may be coaxial with the conductive structure 11. In such a configuration, when the winding 10 is wound outwardly along the radial direction D1 to be a multi-layered structure, the conductive structure 11 and the insulation structure 12 can be arranged alternately, and therefore, the insulation structure 12 can separate the portions of the conductive structure 11 that are positioned on different layers, so as to maybe prevent the portions of the conductive structure 11 on different layers from electrically being connected to each other.

Figure 4:
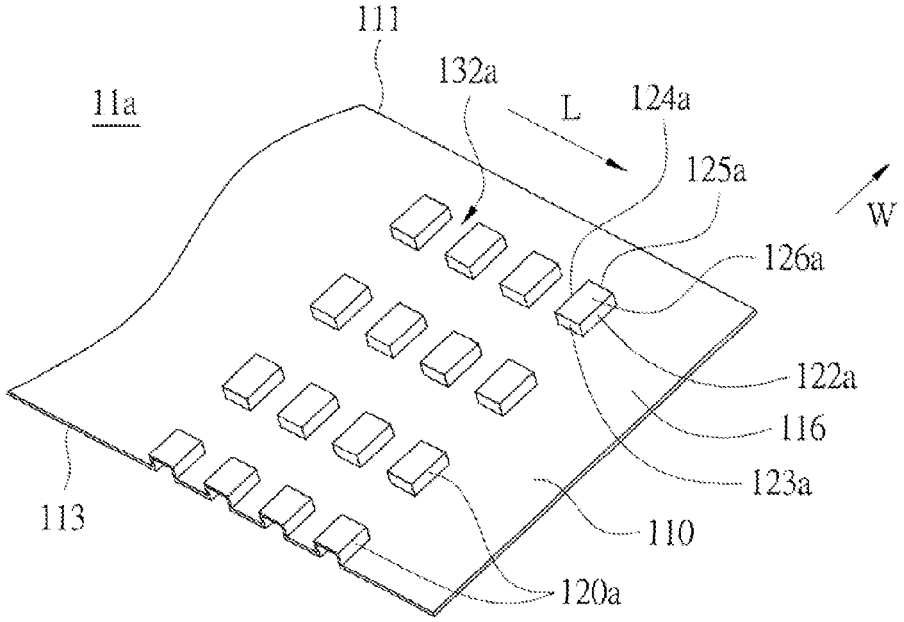
FIG. 4 is a fragmentary perspective view of the conductive structure in accordance with another embodiment of the present disclosure.

FIG. 4 is a fragmentary perspective view of the conductive structure 11*a* in accordance with another embodiment of the present disclosure. As shown in FIG. 4, the main difference between the conductive structure 11*a* and the foregoing conductive structure 11 is that: at least two of the protrusions 120*a* are spatially separated from each other along the widthwise direction W. These protrusions 120*a* are arranged along a direction that is not parallel to the lengthwise direction L of the conductive sheet 110. In particular, the protrusions 120*a* may be arranged in a row along the widthwise direction W of the conductive sheet 110 and the protrusions 120*a* in the same row are spatially separated from each other along the widthwise direction W. The first heat dissipation passage 132*a* is positioned between two protrusions 120*a* adjacent to each other. For example, two protrusions 120*a* adjacent to each other along the lengthwise direction L are aligned along the lengthwise direction L, so as to form the first heat dissipation passage 132*a* therebetween.

It is understood that the "objects in the same row" in this context are the objects arranged along the widthwise direction W. For example, the protrusions 120*a* in the same row are the protrusions 120*a* arranged along the widthwise direction W.

In some embodiments, as shown in FIG. 4, the protrusions 120*a* in the same row are aligned along the widthwise direction W of the conductive sheet 110. In particular, each of the protrusions 120*a* includes two opposite supports 122*a* and 124*a*. The supports 122*a* and 124*a* can be two parallel walls, and they are parallel to the widthwise direction W of the conductive sheet 110. The supports 122*a* of two adjacent protrusions 120*a* in the same row are coplanar. Similarly, the supports 124*a* of two adjacent protrusions 120*a* in the same row are coplanar. As such, two adjacent protrusions 120*a* in the same row can be aligned with each other along the widthwise direction W of the conductive sheet 110.

In some embodiments, as shown in FIG. 4, each of the protrusions 120*a* has a rectangular cross-sectional pattern. In particular, each of the protrusions 120*a* includes another two opposite supports 123*a*, 125*a* and a top plate 126*a*. The supports 123*a* and 125*a* are two parallel walls, and they are parallel to the lengthwise direction L of the conductive sheet 110. The supports 122*a*, 123*a*, 124*a* and 125*a* are connected sequentially, and they are connected to the connecting surface 116 of the conductive sheet 110. The top plate 126*a* is connected to sides of the supports 122*a*, 123*a*, 124*a* and 125*a* farthest from the connecting surface 116, so as to form the rectangular cross-sectional pattern. In other embodiments, one of the protrusions 120*a* can have, but is not limited to have, a diamond-shaped cross-sectional pattern, a circular cross-sectional pattern, an elliptic cross-sectional pattern or a triangular cross-sectional pattern.

Other features of the conductive structure 11*a* are similar to the foregoing description relating to the conductive structure 11, and are not described repeatedly.

Figure 5:
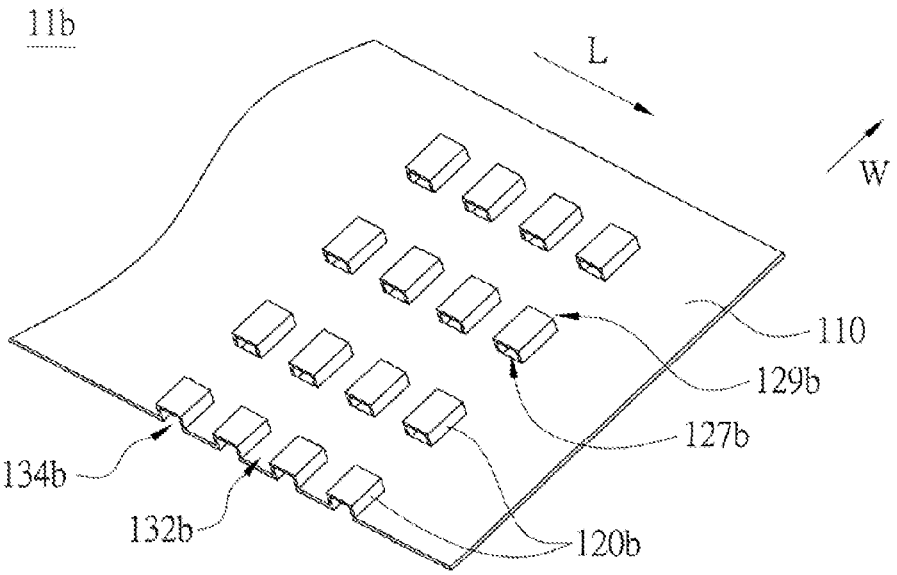
FIG. 5 is a fragmentary perspective view of the conductive structure in accordance with another embodiment of the present disclosure.

FIG. 5 is a fragmentary perspective view of the conductive structure 11*b* in accordance with another embodiment of the present disclosure. As shown in FIG. 5, the main difference between the conductive structure 11*b* and the conductive structure 11*a* is that: at least one of the protrusions 120*b* is a hollow structure having two openings 127*b* and 129*b* on opposite ends thereof. In other words, the openings 127*b* and 129*b* are spatially connected to each other and the widthwise direction W of the conductive sheet 110 extends across the openings 127*b* and 129*b*. As such, the protrusions 120*b* in the same row can form the second heat dissipation passage 134*b* via the openings 127*b* and 129*b*, which allows the airflow to flow therethrough. The second heat dissipation passage 134*b* and the first heat dissipation passage 132*b* are arranged alternately. In other words, the airflow not only contacts with the outer surface of the protrusion 120*b*, but also contacts with the inner surface of the protrusion 120*b*, so as to maybe increase the contacting surface and improve the heat dissipation ability.

Other features of the conductive structure 11*b* are similar to the description relating to the conductive structure 11*a*, and are not described repeatedly.

Figure 6:
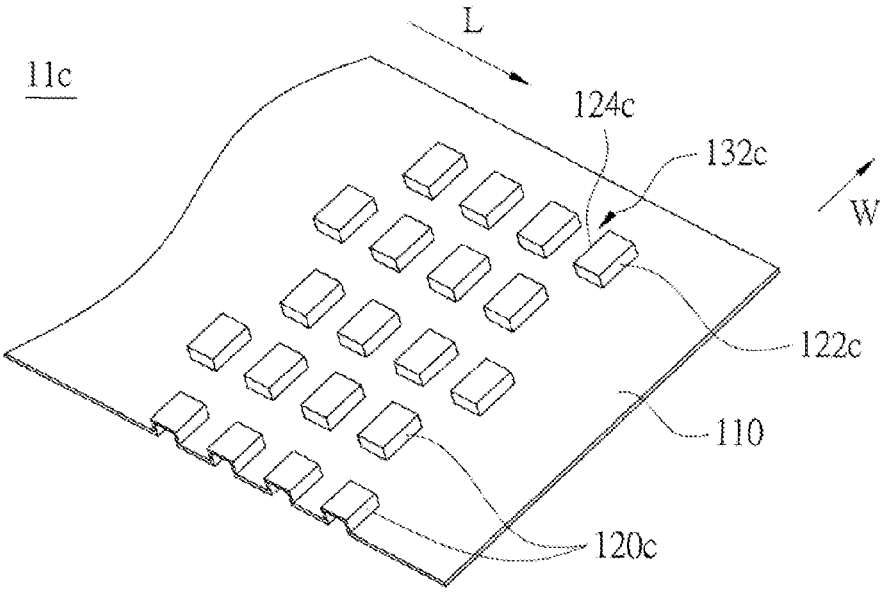
FIG. 6 is a fragmentary perspective view of the conductive structure in accordance with another embodiment of the present disclosure.

FIG. 6 is a fragmentary perspective view of the conductive structure 11*c* in accordance with another embodiment of the present disclosure. As shown in FIG. 6, the main difference between the conductive structure 11*c* and the conductive structure 11*a* is that: adjacent two of the protrusions 120*c* in the same row are misaligned along the widthwise direction W. In particular, each of the protrusions 120*c* has supports 122*c* and 124*c* parallel to the widthwise direction W of the conductive sheet 110. The supports 122*c* of adjacent two of the protrusions 120*c* in the same row are not coplanar. Similarly, the supports 124*c* of adjacent two of the protrusions 120*c* in the same row are not coplanar. As such, adjacent two of the protrusions 120*c* in the same row can be misaligned along the widthwise direction W.

Through the foregoing misalignment design, the airflow in the first heat dissipation passage 132*c* tends to form turbulence, which may increase the heat transfer coefficient, thereby maybe improving the heat dissipation ability.

Other features of the conductive structure 11*c* are similar to the foregoing description relating to the conductive structure 11*a*, and are not described repeatedly.

Figure 7:
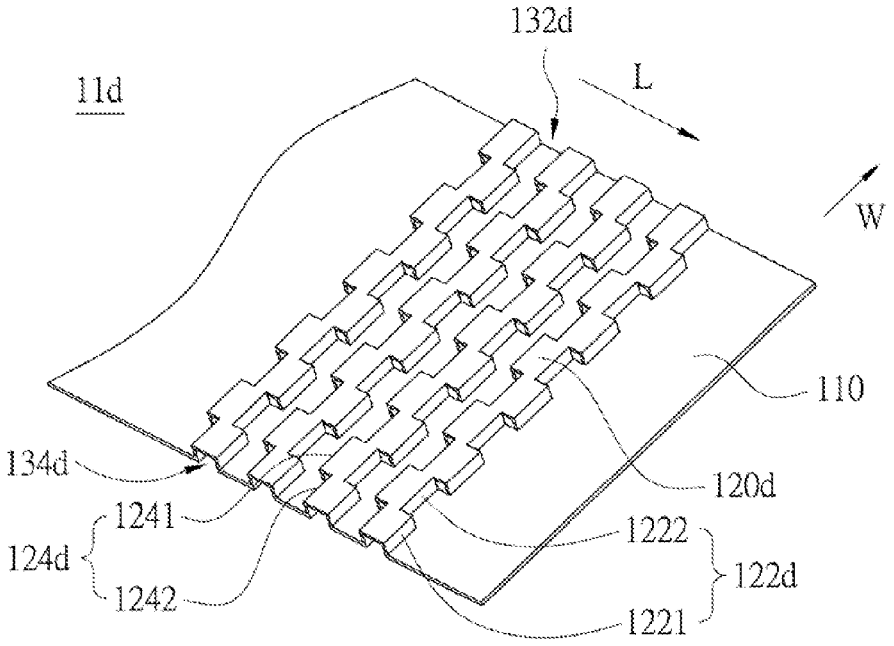
FIG. 7 is a fragmentary perspective view of the conductive structure in accordance with another embodiment of the present disclosure.

FIG. 7 is a fragmentary perspective view of the conductive structure 11*d* in accordance with another embodiment of the present disclosure. As shown in FIG. 7, the main difference between the conductive structure 11*d* and the conductive structure 11 (See FIG. 3) is that: the supports 122*d* and 124*d* of the protrusion 120*d* being the stick are uneven. For example, the support 122*d* includes a plurality of protruded surfaces 1221 and a plurality of concave surfaces 1222. The protruded surfaces 1221 and the concave surfaces 1222 are arranged alternately. The protruded surfaces 1221 and the concave surfaces 1222 are parallel to the widthwise direction W of the conductive sheet 110, and the protruded surface 1221 and the concave surface 1222 are not coplanar. As such, the support 122*d* can be uneven. Similarly, the support 124*d* includes a plurality of protruded surfaces 1241 and a plurality of concave surfaces 1242. The protruded surfaces 1241 and the concave surfaces 1242 are arranged alternately. The protruded surfaces 1241 and the concave surfaces 1242 are parallel to the widthwise direction W of the conductive sheet 110, and the protruded surface 1241 and the concave surface 1242 are not coplanar. As such, the support 124*d* can be uneven.

Through the uneven design to the supports 122*d* and 124*d*, the airflow in the first heat dissipation passage 132*d* and the second heat dissipation passage 134*d* tends to form turbulence, which may increase the heat transfer coefficient, thereby maybe improving the heat dissipation ability.

In some embodiments, in each of the protrusions 120*d*, the protruded surface 1221 of the support 122*d* and the concave 1242 of the support 124*d* are aligned along the lengthwise direction L of the conductive sheet 110. Similarly, the concave surface 1222 of the support 122*d* and the protruded surface 1241 of the support 124*d* are aligned along the lengthwise direction L of the conductive sheet 110, so as to make the first heat dissipation passage 132*d* and the second heat dissipation passage 134*d* meandering, thereby maybe improving the turbulent airflow.

Other features of the conductive structure 11*d* are similar to the foregoing description relating to the conductive structure 11 (See FIG. 3), and are not described repeatedly.

Figure 8:
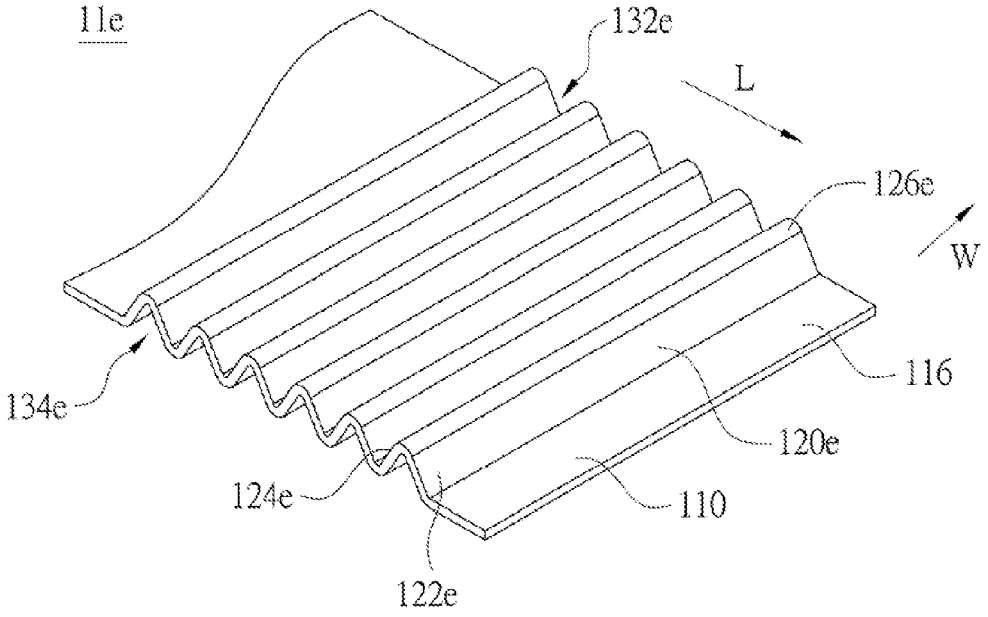
FIG. 8 is a fragmentary perspective view of the conductive structure in accordance with another embodiment of the present disclosure.

FIG. 8 is a fragmentary perspective view of the conductive structure 11*e* in accordance with another embodiment of the present disclosure. As shown in FIG. 8, the main difference between the conductive structure 11*e* and the conductive structure 11 (See FIG. 3) is that: the cross-sectional pattern of the protrusion 120*e* defined along the direction perpendicular to the connecting surface 116 is inverted-V shaped. In particular, the supports 122*e* and 124*e* of the protrusion 120*e* are obliquely connected to the connecting surface 116 of the conductive sheet 110, and the top plate 126*e* is arc-shaped and is connected to the sides of the supports 122*e* and 124*e* farthest from the conductive sheet 110. The cross-sectional pattern of the supports 122*e*, 124*e* and top plate 126*e* defined along the direction perpendicular to the connecting surface 116 may be inverted-V shaped. In such a configuration. The first heat dissipation passage 132*e* and the second heat dissipation passage 134*e* can be formed in the shape different from the first heat dissipation passage 132 and the second heat dissipation passage 134 as shown in FIG. 3.

Other features of the conductive structure 11*e* are similar to the foregoing description relating to the conductive structure 11 (See FIG. 3), and are not described repeatedly.

Figure 9:
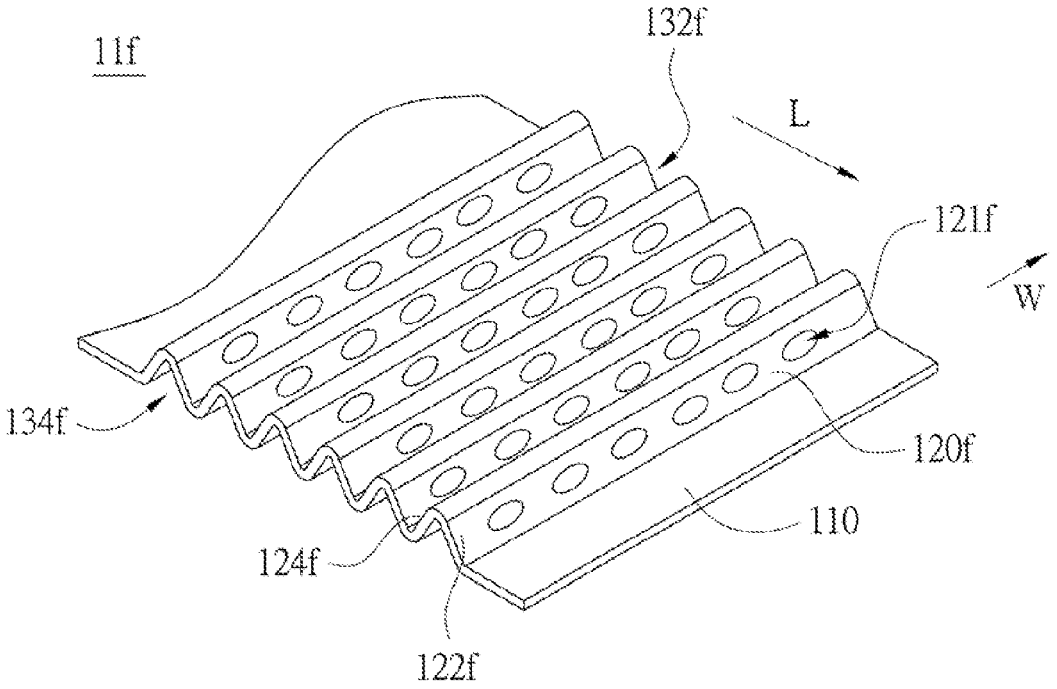
FIG. 9 is a fragmentary perspective view of the conductive structure in accordance with another embodiment of the present disclosure.

FIG. 9 is a fragmentary perspective view of the conductive structure 11*f* in accordance with another embodiment of the present disclosure. As shown in FIG. 9, the main difference between the conductive structure 11*f* and the conductive structure 11*e* is that: the support 122*f* or 124*f* of the protrusion 120*f* being the stick has at least one through hole 121*f*. The through hole 121*f* connects the first heat dissipation passage 132*f* and the second heat dissipation passage 134*f*. As such, the airflow in the first heat dissipation passage 132*f* and the airflow in the second heat dissipation passage 134*f* can be mixed with each other, so as to maybe facilitate the turbulent flow, thereby maybe improving the heat dissipation ability.

In some embodiments, the supports 122*f* and 124*f* can have through holes 121*f*, so as to maybe facilitate to mix the airflow, thereby maybe improving the heat dissipation ability.

In this embodiment, the protrusion 120*f* being the stick is taken as an example, but in other embodiments, as shown in FIG. 4, the supports 122*a* and 124*a* of the protrusion 120*a* can also have through holes 121*f*, so as to maybe facilitate the turbulent flow, thereby maybe improving the heat dissipation ability.

Other features of the conductive structure 11*f* are similar to the foregoing description relating to the conductive structure 11*e*, and are not described repeatedly.

Figure 10:
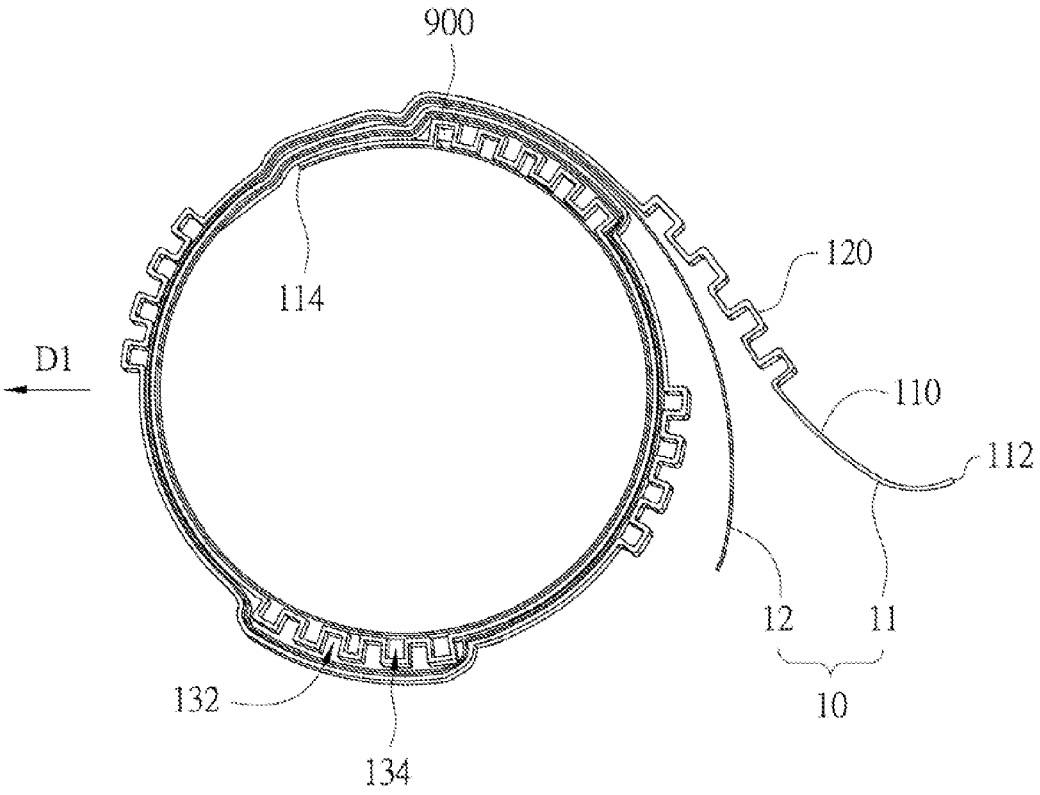
FIG. 10 is a top view of the electromagnetic device in accordance with another embodiment of the present disclosure.

FIG. 10 is a top view of the electromagnetic device in accordance with another embodiment of the present disclosure. As shown in FIG. 10, the main difference between this embodiment and FIG. 2 is that: the electromagnetic device further includes at least one block 900, one of the protrusions 120 is a hollow structure, and the block 900 is arranged in the protrusion 120 being the hollow structure, so as to maybe prevent deformation of the protrusion 120 when it is exerted by an external force. In some embodiments, only some protrusions 120 have blocks 900 therein, and other protrusions 120 do not have blocks 900 therein, so as to maybe prevent from affecting the airflow and reducing the heat dissipation ability.

Figure 11:
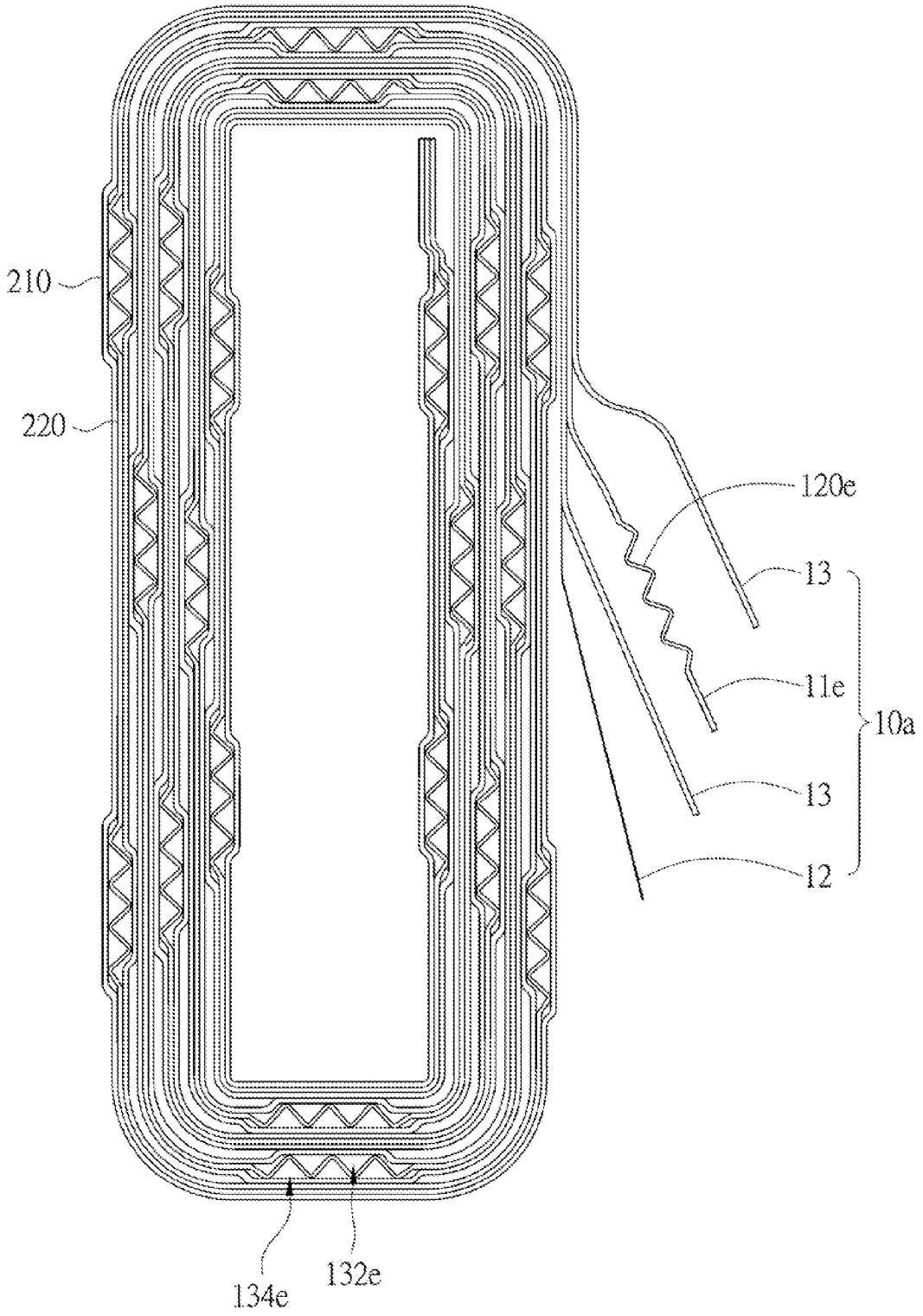
FIG. 11 is a top view of the electromagnetic device in accordance with another embodiment of the present invention.

FIG. 11 is a top view of the electromagnetic device in accordance with another embodiment of the present invention. As shown in FIG. 11, the winding 10*a* includes a conductive structure 11*e*, an insulation structure 12 and at least one current sharing structure 13. The conductive structure 11*e*, the insulation structure 12 and the current sharing structure 13 are cooperatively wound as a cylinder, and they are coaxial. The current sharing structure 13 contacts with the conductive structure 11*le* to prevent from the deformation of the protrusions 120*e* of the conductive structure 11*e*. For example, there are two current sharing structures 13, and the conductive structure 11*e* can be sandwiched between the current sharing structures 13, so as to maybe prevent from the external force exerting to the protrusions 120*e*, thereby maybe preventing from the deformation of the protrusions 120*e*.

In some embodiment, the current sharing structure 13 is a conductor. Therefore, when the conductive structure 11*e* is conducted, the current not only flows through the conductive structure 11*e*, but also flows through the current sharing structure 13. In other words, the current may flow through plural paths, and therefore, even though the impedance of the conductive structure 11*e* may increase because the uneven shape of the protrusions 120*e*, the current may flow through the current sharing structure 13 with lower impedance. As such, the whole impedance of the winding 10*a* may be lowered.

Moreover, when the conductive structure 11*e* is conducted, it may be affected by the magnetic field generated from the electromagnetic induction, such that a great portion of the current may flow on the surface of the conductive structure 11*e*, which may form an uneven distribution of current and increase the impedance. This effect is also called the skin effect. However, because the current sharing structure 13 can transfer the current as well, the current not only flows on the surface of the conductive structure 11*e*, but also flows through the current sharing structure 13, which may alleviate the affect of the skin effect.

In some embodiments, as shown in FIG. 11, the current sharing structure 13 has a supporting area 210 and a non-supporting area 220. The non-supporting area 220 is adjoined to the supporting area 210. The supporting area 210 contacts with the protrusions 120*e* of the conductive structure 11*e*. In this embodiment, the supporting area 210 is flat to resist the external force and to protect the protrusions 120*e*.

The non-supporting area 220 does not contact with the protrusions 120*e*. As shown in FIG. 11, the non-supporting area 220 may be flat. In other embodiments, the non-supporting area 220 may be uneven to form additional heat dissipation passages, so as to maybe allow the airflow to flow therethrough, which may improve the heat dissipation ability.

In some embodiments, as shown in FIG. 11, the winding 10*e* is wound outwardly along the radial direction, so as to form a cylinder.

In this embodiment, the electromagnetic device takes the conductive structure 11*e* as example, but in other embodiments, the electromagnetic may take the conductive structures 11-11*d* and 11*f* to replace the conductive structure 11*e*.

Figure 12:
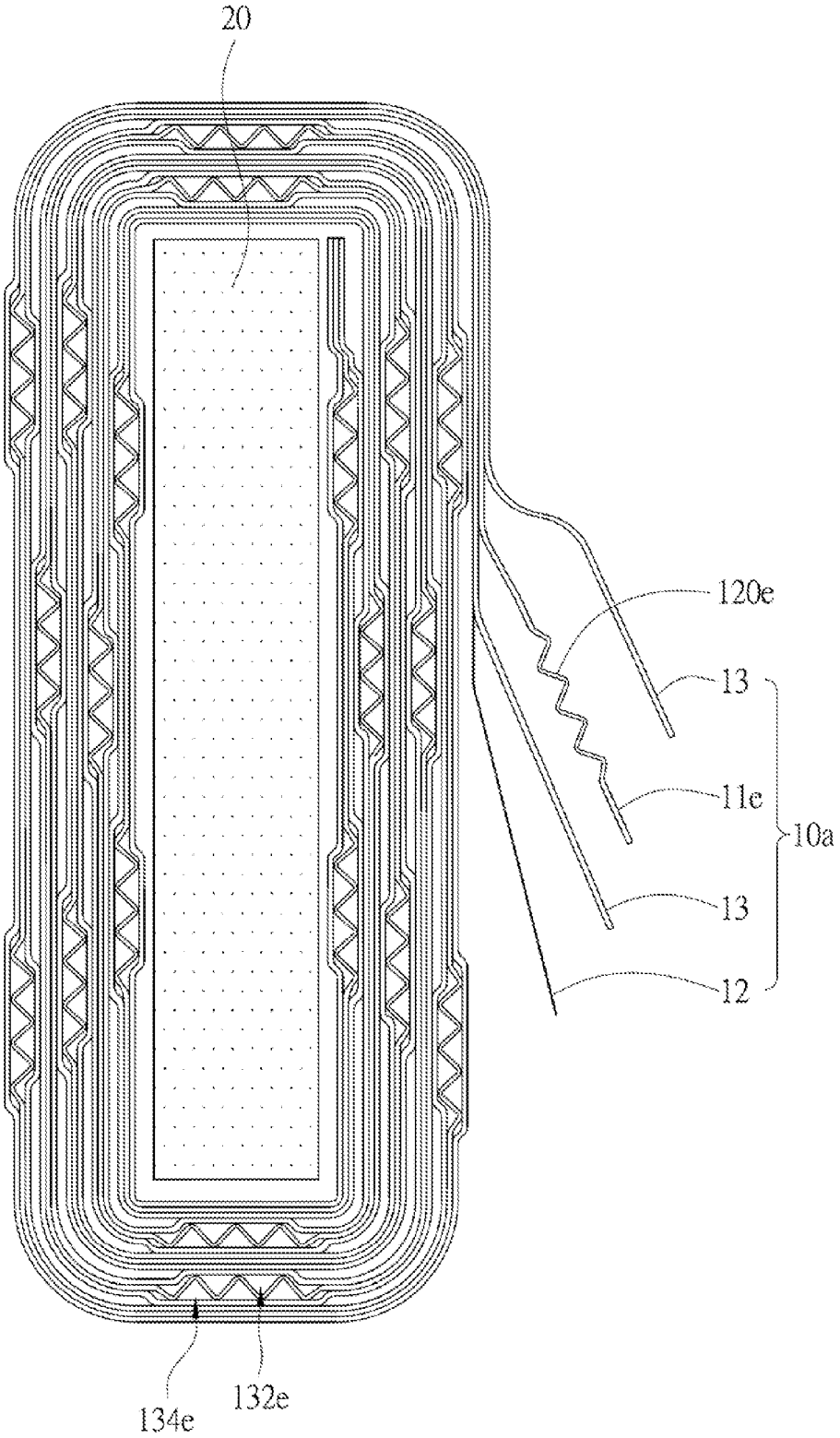
FIG. 12 is a top view of the electromagnetic device in accordance with another embodiment of the present disclosure.

FIG. 12 is a top view of the electromagnetic device in accordance with another embodiment of the present disclosure. The main difference between the electromagnetic device in this embodiment and FIG. 11 is that: the electromagnetic device includes a magnetic core 20. The winding 10*a* surrounds the magnetic core 20. When the current flows through winding 10*a*, the generated magnetic field and the magnetic field of the magnetic core 20 may affect each other. The electromagnetic device may be, but are not limited to be, applied in the single phase reactor, the triple phase reactor, the single phase transformer or the triple phase transformer.

Figure 13:
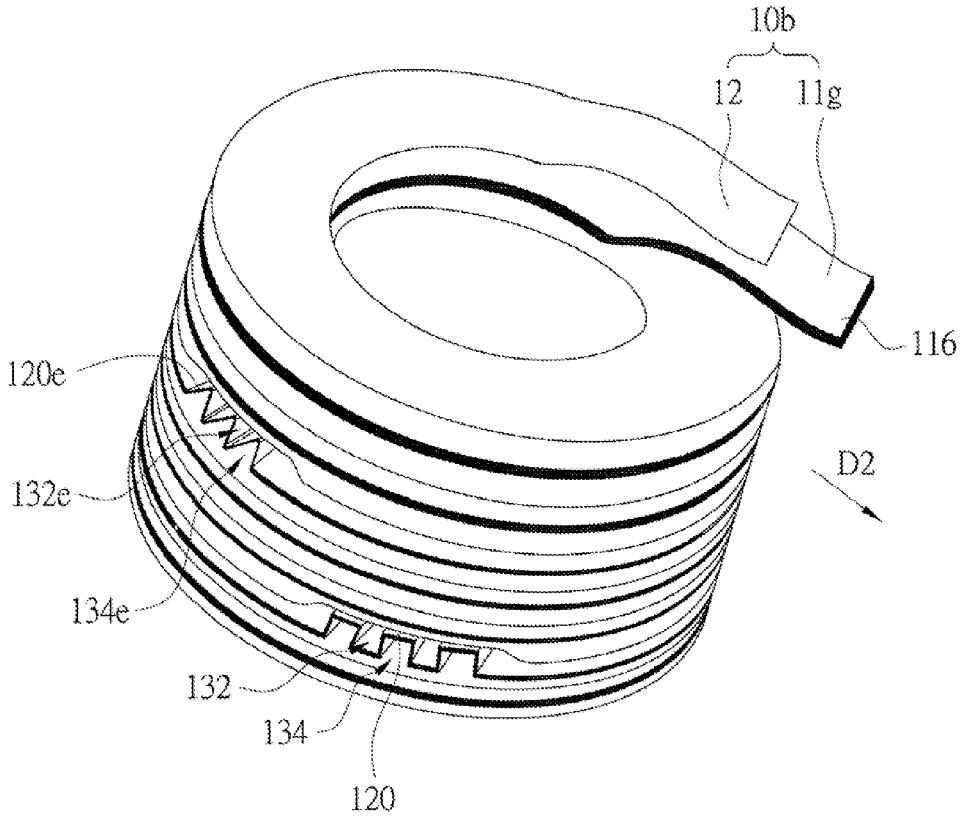
FIG. 13 is a perspective view of the electromagnetic device in accordance with another embodiment of the present disclosure.

FIG. 13 is a perspective view of the electromagnetic device in accordance with another embodiment of the present disclosure. The main difference between the electromagnetic device in this embodiment and FIG. 11 is that: the winding manner of the winding 10*b* is different from which of the foregoing winding 10*a*. In particular, the winding 10*b* is wound along the axial direction from the top side to the bottom side (or vice versa), so as to form a cylinder overlapped from the top side to the bottom side (or vice versa).

The connecting surface 116 of the conductive structure 11*g* is parallel to the radial direction D2 of the winding 10*b*. The conductive structure 11*g* includes a plurality of protrusions 120 and 120*e*. The first heat dissipation passage 132 defined by adjacent two of the protrusions 120 and the second heat dissipation passage 134 within the protrusion 120 extend along the radial direction D2 of the winding 10*b*. In particular, the winding 10*b* is wound as a cylinder, and the radial direction D2 is the direction along the radius of the cylinder. Similarly, the first heat dissipation passage 132*e* defined by adjacent two of the protrusions 120*e* and the second heat dissipation passage 134*e* within the protrusion 120*e* extend along the radial direction D2 of the winding 10*b*. In such a configuration, the airflow may flow through the first heat dissipation passages 132 and 132*e* and the second heat dissipation passages 134 and 134*e* along the radial direction D2 of the winding 10*b*, so as to maybe achieve heat dissipation.

In this embodiment, the conductive structure 11*g* includes the protrusions 120 and 120*e*, but in other embodiments, the conductive structure 11*g* may include the protrusion 120*a*, 120*b*, 120*c*, 120*d* or 120*f* as well.

Figure 14:
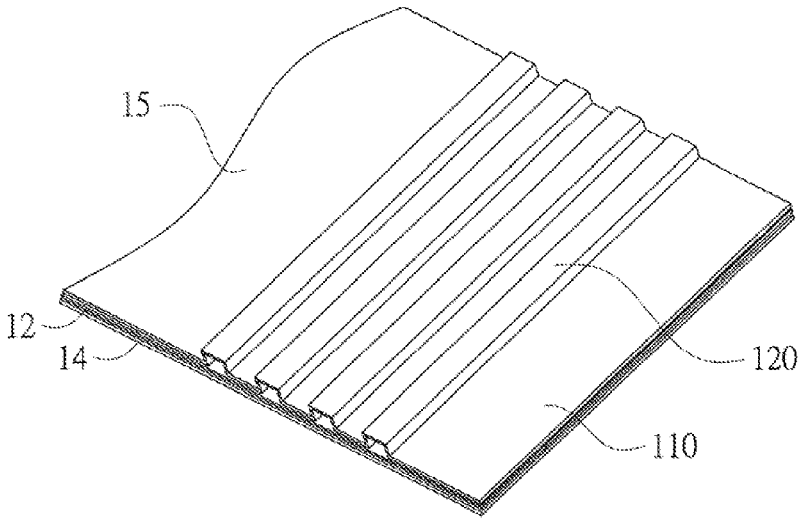
FIG. 14 is a perspective view of the electromagnetic device in accordance with another embodiment of the present disclosure.

FIG. 14 is a perspective view of the electromagnetic device in accordance with another embodiment of the present disclosure. In this embodiment, as shown in FIG. 14, the electromagnetic device includes an insulation structure 12 and two conductive layers 14 and 15. The insulation structure 12 is sandwiched between the conductive layers 14 and 15, so as to separate the conductive layers 14 and 15. As such, the conductive layers 14 and 15 can be seen as two independent circuits insulated from each other, and therefore, the electromagnetic device can be used as a busbar, which can, but is not limited to, electrically connect to the power device, the capacitor or the battery.

In this embodiment, the conductive layer 15 may be any of the conductive structures 11-11*f* shown in FIGS. 3-9. For example, the conductive layer 15 includes a plurality of protrusions 120, so as to maybe improve the heat dissipation ability of the electromagnetic device.

In this embodiment, the surface of the conductive layer 14 is flat. In other embodiments, the conductive layer 14 can be any of the conductive structures shown in FIGS. 3-9 that has any of the protrusions 120-120*f*, so as to maybe improve the heat dissipation ability of the electromagnetic device.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A conductive structure for an electromagnetic device, comprising:

a conductive sheet being wound around an accommodating space and having two electrical connection terminals and a plurality of conductive protruding portions and a plurality of base portions, wherein the conductive protruding portions protrude from the base portions and being arranged between the electrical connection terminals, and two of the conductive protruding portions adjacent to each other define a first heat dissipation passage, wherein at least one of the conductive protruding portions is a hollow structure having two openings on opposite ends thereof and has a second heat dissipation passage, and the second heat dissipation passage and the first heat dissipation passage are arranged alternately.

2. The conductive structure of claim 1, wherein the conductive sheet comprises a top long side and a bottom long side, and the top long side and the bottom long side connect with the electrical connection terminals, wherein at least one of the conductive protruding portions is a stick that connects the top long side and the bottom long side.

3. The conductive structure of claim 2, wherein at least one of the conductive protruding portions being the stick has a support connecting with the base portion, and the support has at least one through hole that connects the first heat dissipation passage and the second heat dissipation passage.

4. The conductive structure of claim 2, wherein at least one of the conductive protruding has a support connecting with the base portion, and the support is flat or uneven.

5. The conductive structure of claim 2, wherein at least one of the base portions is connected to the conductive protruding portions, and at least one of the conductive protruding portions being the stick has a cross-sectional pattern defined along a direction perpendicular to the base portion, and the cross-sectional pattern is inverted-U shaped, inverted-V shaped, trapezoidal or arc-shaped.

6. The conductive structure of claim 1, wherein the conductive sheet has a widthwise direction and has a top long side and a bottom long side, wherein the top long side and the bottom long side are connected to the electrical connection terminals, and the widthwise direction extends across the top long side and the bottom long side, and at least two of the conductive protruding portions are spatially separated from each other along the widthwise direction.

7. The conductive structure of claim 6, wherein at least one of the conductive protruding portions which are separated from each other along the widthwise direction is a hollow structure having two openings on opposite ends thereof, and the conductive protruding portion being the hollow structure has a second heat dissipation passage, and the second heat dissipation passage and the first heat dissipation passage are arranged alternately.

8. The conductive structure of claim 6, wherein adjacent two of the conductive protruding portions which are spatially separated from each other along the widthwise direction are aligned or misaligned along the widthwise direction.

9. The conductive structure of claim 6, wherein at least one of the conductive protruding portions which are spatially separated from each other along the widthwise direction has a rectangular cross-sectional pattern, a diamond-shaped cross-sectional pattern, a circular cross-sectional pattern, an elliptic cross-sectional pattern or a triangular cross-sectional pattern.

10. The conductive structure of claim 1, further comprising at least one block, wherein one of the conductive protruding portions is a hollow structure, and the block is arranged in the conductive protruding portion being the hollow structure.

11. The conductive structure of claim 1, wherein at least one of the base portions is connected to the conductive protruding portions, and the conductive protruding portions have at least two different cross-sectional patterns defined along a direction perpendicular to the base portions.

12. The conductive structure of claim 1, wherein the conductive protruding portions are arranged equidistantly.

13. The conductive structure of claim 1, wherein the conductive protruding portions are arranged non-equidistantly.

14. The conductive structure of claim 1, wherein the conductive protruding portions are arranged on a partial area of the conductive sheet.

15. The conductive structure of claim 1, wherein the conductive protruding portions and the base portions are integrally formed.

16. The conductive structure of claim 1, wherein material of the conductive sheet comprises copper, aluminum, copper alloy or aluminum alloy.

17. An electromagnetic device, comprising:

a winding comprising a conductive structure of claim 1.

18. The electromagnetic device of claim 17, further comprising:

an insulation structure, wherein the conductive structure and the insulation structure are cooperatively wound, and the insulation structure contacts with the conductive structure and is coaxial with the conductive structure.

19. The electromagnetic device of claim 17, further comprising:

a current sharing structure, wherein the conductive structure and the current sharing structure are cooperatively wound, and the current sharing structure contacts with the conductive structure and is coaxial with the conductive structure, wherein the current sharing structure is a conductor.

20. The electromagnetic device of claim 17, further comprising:

a magnetic core surrounded by the winding.

21. An electromagnetic device, comprising:

an insulation structure; and two conductive layers, wherein the insulation structure is sandwiched between the conductive layers, and at least one of the conductive layers is the conductive structure of claim 1.

* * * * *